US007794912B2

(12) United States Patent
Urabe et al.

(10) Patent No.: US 7,794,912 B2
(45) **Date of Patent: *Sep. 14, 2010**

(54) DEVELOPING AGENT AND METHOD FOR MANUFACTURING THE SAME

(75) Inventors: Takashi Urabe, Sunto-gun (JP); Tsuyoshi Ito, Izunokuni (JP); Motonari Udo, Mishima (JP); Masahiro Ikuta, Mishima (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 495 days.

This patent is subject to a terminal disclaimer.

(21) Appl. No.: 11/623,598

(22) Filed: Jan. 16, 2007

(65) Prior Publication Data

US 2008/0171282 A1 Jul. 17, 2008

(51) Int. Cl.
*G03G 9/113* (2006.01)

(52) U.S. Cl. ..... 430/137.13; 430/137.19

(58) Field of Classification Search ..... 430/137.13, 430/137.19

See application file for complete search history.

(56) References Cited

U.S. PATENT DOCUMENTS

| | | | | |
|---|---|---|---|---|
| 6,132,919 | A * | 10/2000 | Ogawa et al. | 430/108.8 |
| 2004/0048182 | A1 * | 3/2004 | Urabe | 430/110.2 |
| 2005/0196694 | A1 * | 9/2005 | Yuasa et al. | 430/108.4 |
| 2007/0281240 | A1 | 12/2007 | Urabe et al. | |
| 2008/0131808 | A1 * | 6/2008 | Urabe et al. | 430/115 |
| 2008/0171276 | A1 | 7/2008 | Urabe et al. | |

FOREIGN PATENT DOCUMENTS

| | | |
|---|---|---|
| JP | 63-282752 | 11/1988 |
| JP | 06-250439 | 9/1994 |
| JP | 09-311502 | 12/1997 |
| JP | 10-026842 | 1/1998 |
| JP | 3351505 | 9/2002 |
| JP | 2005-284269 | 10/2005 |

* cited by examiner

*Primary Examiner*—John L Goodrow
(74) *Attorney, Agent, or Firm*—Turocy & Watson, LLP

(57) ABSTRACT

A mixture containing a binder resin and a colorant is mixed with an aqueous medium, the resulting mixture liquid is mechanically sheared to finely granulate the mixture, fine particles are formed as cores, and a coating resin layer is formed on core surfaces, to obtain toner particles.

19 Claims, 2 Drawing Sheets

DEVELOPING AGENT AND METHOD FOR MANUFACTURING THE SAME

BACKGROUND OF THE INVENTION

In electrophotography methods, an electric latent image is formed on an image carrier, the latent image is developed with a toner, the resulting toner image is transferred onto a print material such as paper, and the image is fixed by heat, pressure, etc. Only a black toner may be used in conventional manner to form an image, and toners for different colors may be used to form a full color image.

The toners may be used as a 2-component developing agent mixing with carrier particles, or as a 1-component developing agent of a magnetic or nonmagnetic toner. The toners are generally produced by kneading pulverization methods. In the kneading pulverization methods, a binder resin, a pigment, a releasing agent such as a wax, a charge controlling agent, etc. are melt-kneaded, cooled, finely pulverized, and classified to produce desired toner particles. Inorganic and/or organic fine particles are attached to the surfaces of the toner particles produced by the kneading pulverization method in accordance with the intended use, thereby producing the toners.

In the case of using the kneading pulverization methods, it is difficult to purposefully control the shape of the toner particles. Further, particularly when a highly pulverizable material is used, the toner particles tend to be excessively micronized. Thus, in the 2-component developing agents, the micronized toner particles may be bonded to carrier surfaces to accelerate charge deterioration of the developing agents, and in the 1-component developing agents, the micronized toner particles may be scattered and the development property may be lowered due to the toner shape change to deteriorate image qualities. Furthermore, when the toner is pulverized at a boundary between a binder resin and wax, the wax is easily eliminated from the toner, so that developing rollers, image carriers, carriers, etc. are contaminated to reduce reliability of the developing agent.

Under such circumstances, emulsion polymerization aggregation methods have recently been proposed as methods of purposefully controlling shape and surface composition of toner particles in JP-A-63-282752 and JP-A-6-250439.

In the emulsion polymerization aggregation methods, a resin dispersion liquid is prepared by emulsion polymerization, a colorant dispersion liquid is prepared by dispersing a colorant in a solvent, the dispersion liquids are mixed to form aggregated particles with diameters appropriate for toner particles, and the aggregated particles are fused by heating to obtain toner particles. The shape of the toner particles can be controlled to be amorphous or spherical by changing the heating temperature in the emulsion polymerization aggregation methods.

In the emulsion polymerization aggregation methods, at least the fine resin particle dispersion liquid and the colorant dispersion liquid are aggregated and fused under predetermined conditions to obtain a toner. However, only limited resins can be synthesized in the emulsion polymerization aggregation methods. The methods cannot be used for producing polyester resins known as excellent in fixity though they are suitable for producing acrylic styrene copolymers.

Though phase inversion emulsification methods, which contain dissolving a polyester resin in an organic solvent, adding a pigment dispersion liquid, etc. thereto, and then adding water, are known as methods for producing toners using polyester resins, the methods require the processes of removing and recovering the organic solvent. A method for producing fine particles by mechanical shearing in an aqueous medium without using organic solvents is proposed in JP-A-9-311502, and however a resin melt, etc., hard to handle, has to be supplied to a stirring apparatus in the method. Further, the method is poor in freedom of shape control, and the toner shape cannot be freely controlled to be amorphous, spherical, etc.

BRIEF SUMMARY OF THE INVENTION

In view of the above problems, an object of the present invention is to provide a method for manufacturing a developing agent, which can utilize an aqueous medium and can produce a developing agent having a reduced particle diameter, controlled shape, more uniform surface composition, excellent fixity, and excellent transfer property.

The method of the invention for manufacturing a developing agent contains the steps of: mixing a mixture containing a binder resin and a colorant or granulated mixture containing a binder resin and a colorant with an aqueous medium; subjecting the resultant liquid to mechanical shearing, thereby fine-granulating the mixture to form fine particles as cores; and forming a coating resin-containing layer on the surfaces of the cores.

The developing agent of the invention contains fine particles prepared by mixing a mixture containing a binder resin and a colorant with an aqueous medium and by subjecting the resultant liquid to mechanical shearing.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Figure 1:
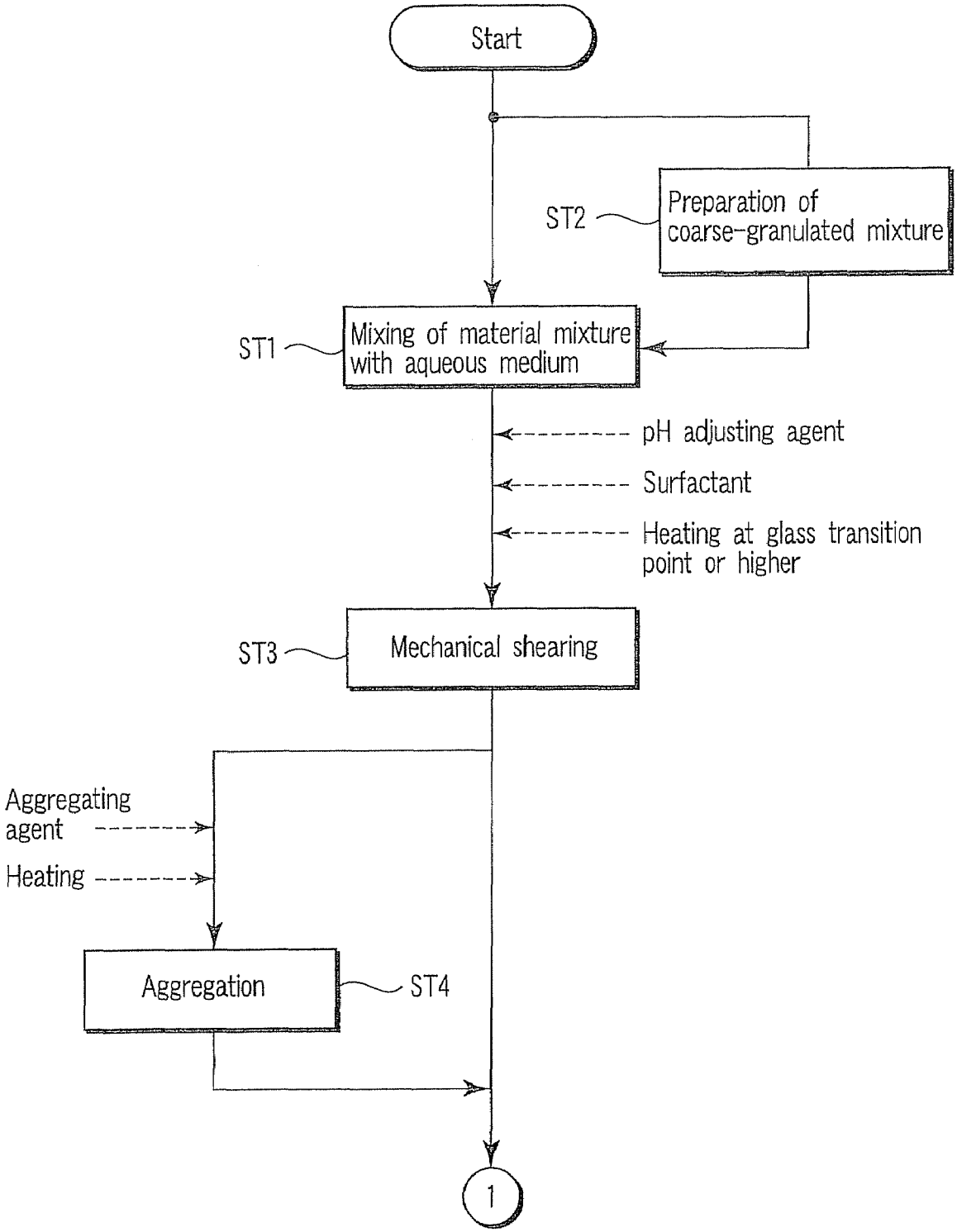
FIGS. 1 and 2 are flow diagrams showing an example of the method of the invention for manufacturing a developing agent.

The method of the present invention for manufacturing a developing agent essentially contains the steps of: mixing a mixture containing at least a binder resin and a colorant or granulated mixture containing at least a binder resin and a colorant with an aqueous medium; subjecting the resultant liquid to mechanical shearing, thereby fine-granulating the mixture granulated to form fine particles as cores; and forming a coating resin layer on the surfaces of the cores to obtain toner particles.

The developing agent of the invention is an agent obtainable by the method, which has toner particles containing cores of fine particles and a coating resin layer formed thereon. The fine particles may be obtained by mixing a material mixture containing a binder resin and a colorant with an aqueous medium, and by subjecting the resulting liquid to mechanical shearing.

The fine particles may be aggregated to form aggregated particles, and the aggregated particles may be used as the cores, on which the coating resin layer is formed.

Thus, the method of the invention may further contain the step of aggregating the fine particles to form the aggregated particles before the step of forming the coating resin layer.

The step of forming the coating resin layer may be carried out in any one of the following 3 manners.

In a first manner, a dispersion liquid of a coating resin is added to a dispersion liquid containing the fine particles or aggregated particles thereof, the dispersion liquids are wet-mixed, and whereby the coating resin layer is formed on the fine particles or the aggregated particles.

In a second manner, a starting material for the coating resin, such as a monomer, is added to a dispersion liquid containing the fine particles or aggregated particles thereof, and while polymerizing the coating resin, the coating resin is attached to the fine particles or aggregated particles, to form the coating resin layer.

In a third manner, the fine particles or aggregated particles thereof are dried and dry-mixed with fine coating resin particles, so that the fine coating resin particles are attached to the fine particles or the aggregated particles, to form the coating resin layer.

In the invention, the material containing the binder resin and the colorant, which may be granulated, is mixed with the aqueous medium and mechanically sheared, whereby the material can be finely pulverized and granulated. Thus, various binder resins can be used in combination with environment-friendly aqueous media unnecessary to recover, and a developing agent having a reduced particle diameter, controlled shape, uniform surface composition, sufficient fixity, and sufficient transfer property can be produced. Further, in the invention, because the toner particles are coated with the coating resin, the components such as the colorant in the toner particles can be prevented from being nonuniformly located on the toner particle surfaces, thereby reducing the charge property and life stability.

Further, such a developing agent can form excellent images.

The invention will be described in more detail below with reference to the drawings.

Figure 2:
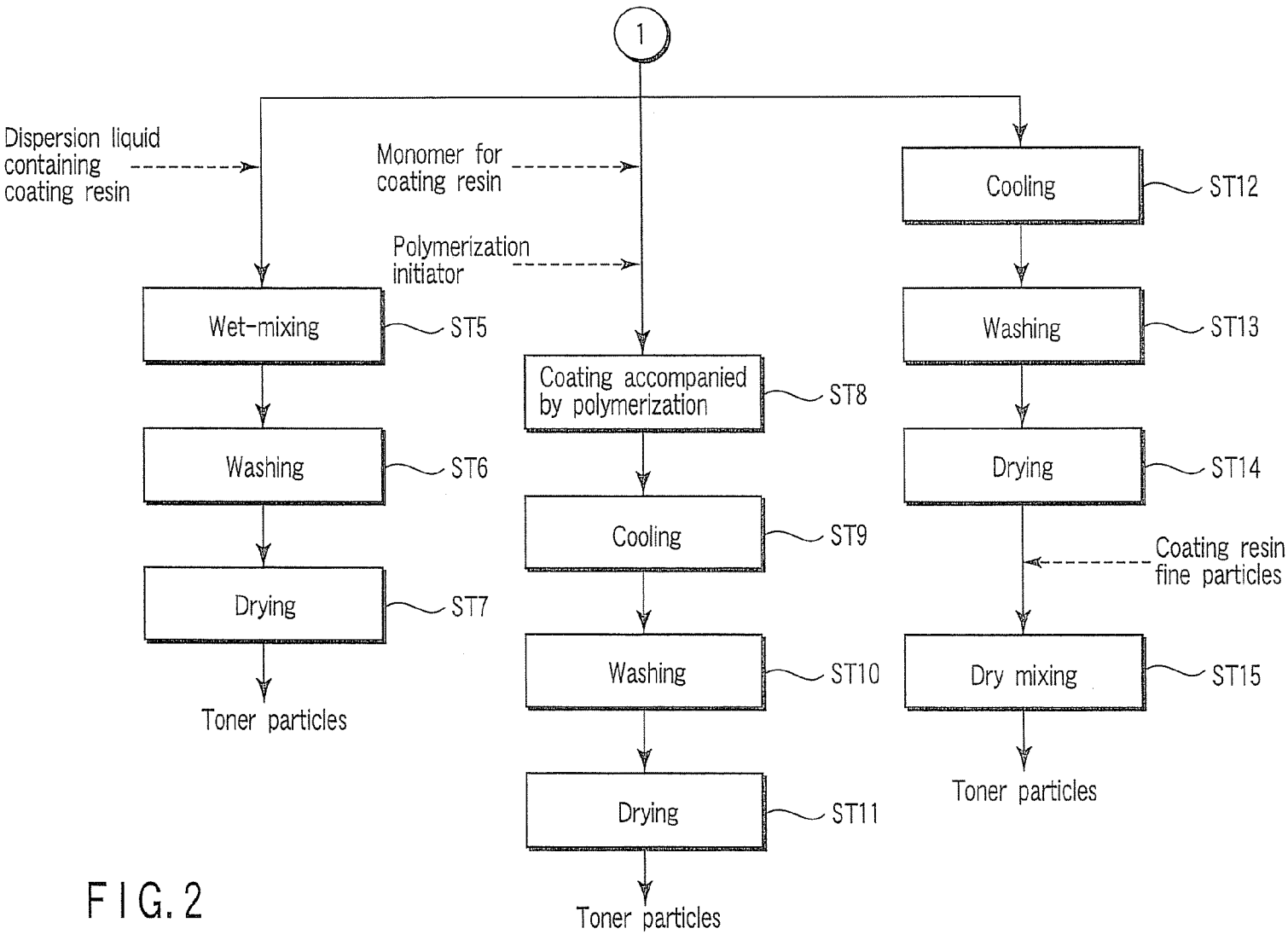

FIGS. 1 and 2 are flow diagrams showing an example of a method for producing the toner particles contained in the developing agent of the invention.

As shown in the drawings, in the method of the invention for manufacturing a developing agent, first the material mixture containing the binder resin and the colorant or the coarse-granulated material mixture containing the binder resin and the colorant is mixed with the aqueous medium (ST1).

The material mixture may contain additives such as waxes and charge controlling agents in addition to the binder resin and the colorant.

The coarse-granulated mixture containing the binder resin and the colorant may be prepared before mixing the material mixture with the aqueous medium, if necessary (ST2).

For example, the coarse-granulated mixture may be prepared by melt-kneading and coarse-pulverizing a mixture containing the binder resin and the colorant. Or alternatively, the coarse-granulated mixture may be prepared by granulating a mixture containing the binder resin and the colorant.

The coarse-granulated mixture preferably has a volume average particle diameter of 0.015 to 10 mm.

When the volume average particle diameter is less than 0.015 mm, the production of the coarse-granulated mixture is highly costly, and in addition the granulated mixture has to be mixed with the aqueous medium by vigorous stirring and bubbles generated by the stirring deteriorate the dispersion of the mixture. When the volume average particle diameter is more than 10 mm, the diameter is excessively large as compared with a gap formed in a shearing part of a mechanical shearing apparatus, whereby the shearing part may be plugged with the particles, and the composition and the diameter of the particles are often made nonuniform due to the energy difference between the inside and outside of the mixture.

The coarse-granulated mixture more preferably has a volume average particle diameter of 0.02 to 5 mm.

In the step of mixing the material mixture with the aqueous medium, at least one of surfactants and pH adjusting agents may be added to the aqueous medium optionally.

In the case of adding the surfactant, the mixture can be easily dispersed in the aqueous medium by the surfactant adsorbed to the mixture surface. On the other hand, the pH adjusting agent acts to increase the polarity and the dissociation degree of dissociable functional groups on the mixture surface, thereby improving the self-dispersibility.

Then, the resultant mixture liquid is subjected to mechanical shearing, so that the coarse-granulated mixture is finely grained to form the fine particles (ST3).

The mechanical shearing may be carried out at a temperature equal to or higher than the glass transition point of the binder resin.

In the invention, by carrying out the mechanical shearing at the temperature equal to or higher than the glass transition point in the aqueous medium, the flowability of the binder resin in the coarse-granulated mixture can be maintained, and the mixture can be finely granulated while coating the dispersed particle surfaces with a desired material. Thus, the resultant toner particles have more uniform surface composition as compared with toner particles obtained by pulverizing methods.

In the invention, the size of the fine particles to be obtained can be controlled by changing the shearing temperature, the shearing time, and the revolution rate of a stirring apparatus, etc. used in the mechanical shearing.

In the case of using the fine particles without the aggregating step, the fine particles used as the cores preferably has a volume average particle diameter of 1 to 10 μm.

The fine particles may be aggregated if necessary, and thus obtained aggregated particles may be used as the cores. In this case, the fine particles formed by the mechanical shearing preferably have a volume average particle diameter of 0.05 to 5 μm.

An aggregating agent may be added to the mixture liquid to form the aggregated particles.

To fuse the aggregated particles, the mixture liquid may be heated to a temperature of the binder resin glass transition point +5 to +80° C.

In the step of forming the aggregated particles, a plurality of the fine particles may be aggregated by at least one process of pH control, addition of a surfactant, addition of a water-soluble metal salt, addition of an organic solvent, and temperature control. The shape of the aggregated particles to be obtained can be controlled by selecting the processes.

The aggregated particles preferably have a volume average particle diameter of 1 to 15 μm.

When the volume average particle diameter of the aggregated particles is 1 μm or less, it tends to be difficult to control the behavior of the toner particles in development and transfer processes. When the diameter is more than 15 μm, the thin line reproducibility tends to be lowered.

The toner particles preferably have a circularity of 0.8 to 1.0.

When the toner particles have a circularity of less than 0.8, the shapes of the particles are often nonuniform, resulting in poor transfer efficiency.

Then on thus-obtained fine particles or aggregated particles are formed the coating resin layer in any one of the following 3 manners.

In the first manner, a dispersion liquid containing the coating resin is added to a dispersion liquid containing the fine particles or aggregated particles, and the dispersion liquids are wet-mixed (ST5), so that the coating resin layer is formed on the fine particles or aggregated particles.

The coating resin in the dispersion liquid is preferably in the form of particles.

The coating resin particles preferably have a volume average particle diameter of 0.03 to 1 μm.

When the volume average particle diameter of the coating resin particles is more than 1 μm, the resultant resin layer tends to be thick, resulting in fixity deterioration and coloring strength reduction.

Then, a dispersing agent, etc. is added to the dispersion liquid, and the resultant is heated such that the fine particles or aggregated particles with the coating resin layer formed are heat-fused to stabilize their shapes. It is then washed with an ion-exchange water using a centrifugal separator, etc. (ST6), and dried (ST7), to obtain the toner particles.

In the second manner, a starting material for the coating resin, such as a monomer, is added to a dispersion liquid containing the fine particles or aggregated particles, a polymerization initiator, etc. is added thereto, and the particles are subjected to coating accompanied by polymerization (ST8). The dispersion liquid may be heated if necessary.

Then, a dispersing agent, etc. is added to the obtained dispersion liquid, and the resultant liquid is heated to stabilize the shapes of the fine particles or aggregated particles with the coating resin layer formed, and then cooled (ST9). It is then washed with an ion-exchange water using a centrifugal separator, etc. (ST10), and dried (ST11), to obtain the toner particles.

In the third manner, a dispersion liquid containing the fine particles or aggregated particles is cooled (ST12), and washed with an ion-exchange water using a centrifugal separator, etc. (ST13). In the case of using the aggregated particles, the dispersion liquid is heated to a temperature of the binder resin glass transition point +5 to +80° C. to fuse the particles. Then, the resultant is dried (ST14) to obtain dried fine particles or aggregated particles. For example, dried fine coating resin particles are added thereto, and the resultant is dry-mixed (ST15) to obtain the toner particles.

The coating resin particles used therein preferably have a volume average particle diameter of 0.03 to 1 μm.

An additive such as a charge controlling agent may be added to the coating resin fine particles.

An additive such as a fluidizer or a charge controlling agent may be added onto the surface of the obtained toner particles if necessary.

In the case of using the toner particles in a 2-component developing agent, the toner particles may be mixed with a carrier.

Examples of the binder resins used in the invention include styrene resins such as polystyrenes, styrene-butadiene copolymers, and acrylic-styrene copolymers; ethylene resins such as polyethylenes, polyethylene-vinyl acetate copolymers, polyethylene-norbornene copolymers, and polyethylene-vinyl alcohol copolymers; polyester resins; acrylic resins; phenol resins; epoxy resins; allylphthalate resins; polyamide resins; and maleic acid resins. These resins may be used singly or in combination of two or more.

The binder resin preferably has an acid value of 1 or more.

The colorant used in the invention may be a carbon black, or an organic or inorganic, pigment or dye. Examples of the carbon blacks include acetylene blacks, furnace blacks, thermal blacks, channel blacks, and ketjen blacks. Examples of yellow pigments include C.I. Pigment Yellows 1, 2, 3, 4, 5, 6, 7, 10, 11, 12, 13, 14, 15, 16, 17, 23, 65, 73, 74, 81, 83, 93, 95, 97, 98, 109, 117, 120, 137, 138, 139, 147, 151, 154, 167, 173, 180, 181, 183, and 185, and C.I. Vat Yellows 1, 3, and 20. These pigments may be used singly or as a mixture. Examples of magenta pigments include C.I. Pigment Reds 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 146, 150, 163, 184, 185, 202, 206, 207, 209, and 238, C.I. Pigment Violet 19, and C.I. Vat Reds 1, 2, 10, 13, 15, 23, 29, and 35. These pigments may be used singly or as a mixture. Further, examples of cyan pigments include C.I. Pigment Blues 2, 3, 15, 16, and 17, C.I. Vat Blue 6, and C.I. Acid Blue 45. These pigments may be used singly or as a mixture.

At least one of waxes and charge controlling agents may be added to the coarse-granulated mixture.

Examples of the waxes include aliphatic hydrocarbon waxes such as low-molecular-weight polyethylenes, low-molecular-weight polypropylenes, polyolefin copolymers, polyolefin waxes, microcrystalline waxes, paraffin waxes, and Fischer-Tropsch waxes; oxides of aliphatic hydrocarbon waxes such as oxidized polyethylene waxes; block copolymers thereof; plant waxes such as candelilla waxes, carnauba waxes, sumac waxes, jojoba waxes, and rice waxes; animal waxes such as bees waxes, lanolins, and whale waxes; mineral waxes such as ozocerites, ceresines, and petrolatums; waxes mainly composed of fatty acid esters such as montanic ester waxes and castor waxes; and those derived by partly or entirely deoxidizing fatty acid esters, such as deoxidized carnauba waxes. The examples of the waxes further include saturated straight-chain fatty acids such as palmitic acid, stearic acid, montanic acid, and long-chain-alkyl carboxylic acids having longer alkyl groups; unsaturated fatty acids such as brassidic acid, eleostearic acid, and parinaric acid; saturated alcohols such as stearyl alcohol, eicosyl alcohol, behenyl alcohol, carnaubyl alcohol, seryl alcohol, melissyl alcohol, and long-chain-alkyl alcohols having longer alkyl groups; polyhydric alcohols such as sorbitol; fatty acid amides such as linoleic amide, oleic amide, and lauric amide; saturated fatty bisamides such as methylene bisstearic amide, ethylene biscapric amide, ethylene bislauric amide, and hexamethylene bisstearic amide; unsaturated fatty acid amides such as ethylene bisoleic amide, hexamethylene bisoleic amide, N,N'-dioleyladipic amide, and N,N'-dioleylsebacic amide; aromatic bisamides such as m-xylene bisstearic amide and N,N'-distearylisophthalic amide; fatty acid metal salts, which are generally referred to as metallic soap, such as calcium stearate, calcium laurate, zinc stearate, and magnesium stearate; waxes derived from aliphatic hydrocarbon waxes by grafting of vinyl monomers such as styrene and acrylic acid; partially esterified derivatives of polyhydric alcohols and fatty acids such as behenic monoglyceride; and methyl esters having hydroxyl groups obtained by hydrogenation of vegetable oils.

The charge controlling agent for controlling frictional charge quantity may be a metal-containing azo compound, which is preferably a complex or a complex salt of iron, cobalt, or chromium, or a mixture thereof. Further, the charge controlling agent may be a metal-containing salicylic acid derivative, which is preferably a complex or a complex salt of zirconium, zinc, chromium, boron, or a mixture thereof.

The pH adjusting agent used in the invention is preferably an amine compound. Examples of the amine compounds include dimethylamine, trimethylamine, monoethylamine, diethylamine, triethylamine, propylamine, isopropylamine, dipropylamine, butylamine, isobutylamine, sec-butylamine, monoethanolamine, diethanolamine, triethanolamine, triisopropanolamine, isopropanolamine, dimethylethanolamine, diethylethanolamine, N-butyldiethanolamine, N,N-dimethyl-1,3-diaminopropane, and N,N-diethyl-1,3-diaminopropane.

Examples of the surfactants usable in the invention include anionic surfactants such as sulfate ester salts, sulfonate salts, phosphates, and soaps; cationic surfactants such as amine salts and quaternary ammonium salts; and nonionic surfactants such as polyethylene glycol compounds, alkylphenol-ethylene oxide adducts, and polyhydric alcohols.

The mechanical shearing apparatus used in the invention is not particularly limited, and examples thereof include media-less shearing apparatus such as ULTRA TURRAX (available from IKA Japan K.K.), TK AUTO HOMO MIXER (available from Primix Corporation), TK PIPELINE HOMO MIXER (available from Primix Corporation), TK FILMICS (available from Primix Corporation), CLEAR MIX (available from M Technique Co., Ltd.), CLEAR SS5 (available from M Technique Co., Ltd.), CAVITRON (available from Eurotec Ltd.), FINE FLOW MILL (available from Pacific Machinery & Engineering Co., Ltd.), MICROFLUIDIZERS (available from Mizuho Industrial CO., Ltd.), ULTIMIZER (available from Sugino Machine Ltd.), NANOMIZER (available from Yoshida Kikai Co., Ltd.), GENUS PY (available from Hakusui Tech Co., Ltd.), and NEW-GENERATION HOMOZINIZER (available from Beryu Co., Ltd.); and media shearing apparatus such as VISCO MILL (available from Aimex Co., Ltd.), APEX MILL (available from Kotobuki Industries Co., Ltd.), STAR MILL (available from Ashizawa Finetech Ltd.), DCP SUPERFLOW (available from Nippon Eirich Co., Ltd.), MP MILL (available from Inoue Manufacturing Co., Ltd.), SPIKE MILL (available from Inoue Manufacturing Co., Ltd.), MIGHTY MILL (available from Inoue Manufacturing Co., Ltd.), and SC MILL (available from Mitsui Mining, Co., Ltd.).

Preferred among them are high pressure type shearing apparatus and CLEAR MIX utilizing internal shearing force, which can easily fine-granulate viscoelastic resins.

In the invention, the mixture containing the resin and the pigment or the kneaded product thereof is fine-granulated under heating condition using the mechanical shearing apparatus. After the fine-granulating process, the resulting mixture may be cooled to a desired temperature, and may be controlled to a desired temperature for aggregation.

In the invention, a stirring bath having a stirring blade such as an anchor blade, fullzone blade, max blend blade, Hi-F mixer blade, double helical blade, or sunmeller blade may be used in addition to the mechanical shearing apparatus in the wet-mixing step.

In the invention, the mixture containing the binder resin and the colorant may be kneaded to prepare the coarse-granulated mixture.

The kneading apparatus used therefor may be a 1-axis extruder, 2-axis extruder, pressing type kneader, Banbury mixer, Brabender mixer, etc. though it is not particularly limited as long as it can melt-knead. Specific examples thereof include FCM (available from Kobe Steel, Ltd.), NCM (available from Kobe Steel, Ltd.), LCM (available from Kobe Steel, Ltd.), ACM (available from Kobe Steel, Ltd.), KTX (available from Kobe Steel, Ltd.), GT (available from Ikegai Corporation), PCM (available from Ikegai Corporation), TEX (available from The Japan Steel Works, Ltd.), TEM (available from Toshiba Machine Co., Ltd.), ZSK (available from Warner), and KNEADEX (available from Mitsui Mining, Co., Ltd.)

In the invention, a water-soluble metal salt may be used in the case of aggregating the fine particles. Examples of the water-soluble metal salts include metal salts such as sodium chloride, calcium chloride, calcium nitrate, barium chloride, magnesium chloride, zinc chloride, magnesium sulfate, aluminum chloride, and aluminum sulfate; and polymerized inorganic metal salts such as polyaluminum chloride, polyaluminum hydroxide, and calcium polysulfide.

In the invention, an organic solvent may be used in the case of aggregating the fine particles. Examples of the organic solvent include alcohols such as methanol, ethanol, 1-propanol, 2-propanol, 2-methyl-2-propanol, 2-methoxyethanol, 2-ethoxyethanol, and 2-butoxyethanol; acetonitrile; and 1,4-dioxane.

The toner surface is coated with a material containing at least the resin in the invention, though the coating method is not particularly limited.

For example, in the case of carrying out the dry-mixing, HYBRIDIZER (available from Nara Machinery Co., Ltd.), COSMOS SYSTEM (available from Kawasaki Heavy Industries, Ltd.), MECHANOFUSION (available from Hosokawa Micron Corporation), MECHANOMILL (available from Okada Seiko Co., Ltd.), etc. may be used as an apparatus for mechanical stirring for coating. A heat treatment may be carried out to make the surfaces of the coated particles more uniform, and SURFUSING SYSTEM (available from Nippon Pneumatic Mfg. Co., Ltd.), etc. is preferably used in the treatment.

Further fine particles may be added to the obtained dispersion liquid, and the coating may be achieved by heteroaggregation. A desirable monomer may be further added to the obtained dispersion liquid, adsorbed to the particles, and polymerized to achieve the coating. Alternatively the monomer may be grown into fine particles without the adsorbing process, and then heteroaggregated. These processes may be carried out at the same time.

In the invention, inorganic fine particles may be added to the surfaces of the toner particles to control the flowability and charge property of the toner particles, and the weight ratio of the inorganic fine particles to the total weight of the toner is 0.01 to 20% by weight. Silica, titania, alumina, strontium titanate, tin oxide, etc. may be used singly or in combination of two or more for the inorganic fine particles.

It is preferred that the inorganic fine particles be surface-treated with a hydrophobizing agent from the viewpoint of improving the environmental stability. In addition to such inorganic oxides, fine resin particles having a size of 1 μm or less may be added to improve the cleaning property.

Examples of apparatus for mixing the inorganic fine particles, etc. include HENSCHEL MIXER (available from Mitsui Mining, Co., Ltd.), SUPERMIXER (available from Kawata Mfg. Co., Ltd.), RIBOCONE (available from Okawara Mfg. Co., Ltd.), NAUTA MIXER (available from Hosokawa Micron Corporation), TERVURIZER (available from Hosokawa Micron Corporation), CYCLOMIXER (available from Hosokawa Micron Corporation), SPIRAL PIN MIXER (available from Pacific Machinery & Engineering Co., Ltd.), and LÖDIGE MIXER (available from Matsubo Corporation).

In the invention, coarse particles, etc. may be separated by sifting. Examples of apparatus for the sifting include ULTRA SONIC (available from Koei Sangyo Co., Ltd.), GYROSIFTER (available from Tokuju Corporation), VIBRASONIC SYSTEM (available from Dalton Co., Ltd.), SONICREEN (available from Sintokogyo, Ltd.), TURBO SCREENER (available from Turbo Kogyo Co., Ltd.), MICROSHIFTER (available from Makino Mfg. Co., Ltd.), and circular vibrating sieves.

The invention will be described in more detail below with reference to Examples.

EXAMPLE 1

90 parts by weight of a binder resin of polyester resin, 5 parts by weight of a colorant of carbon black, 4 parts by weight of an ester wax, and 1 part by weight of a charge controlling agent of zirconia metal complex were mixed and melt-kneaded by a 2-axis kneading apparatus at 120° C., to obtain a kneaded mixture.

The obtained kneaded mixture was coarse-pulverized into a volume average particle diameter of 1.2 mm by HAMMER MILL available from Nara Machinery Co., Ltd. to obtain coarse particles.

40 parts by weight of the coarse particles, 4 parts by weight of an anionic surfactant of sodium dqdecylbenzenesulfonate, 1 part by weight of an amine compound of triethylamine, and 55 parts by weight of an ion-exchange water were put in CLEAR MIX available from M Technique Co., Ltd.

The dispersion liquid in the CLEAR MIX was heated to 95° C., and was mechanically sheared for 30 minutes at a revolution rate of 6,000 rpm of the CLEAR MIX.

After the completion of the mechanical shearing, the dispersion liquid was cooled to ordinary temperature.

The obtained coloring particles had a volume average particle-diameter of 4.5 μm, measured by COULTER COUNTER available from Beckman Coulter, Inc. Thus-obtained dispersion liquid is referred to as Dispersion Liquid 1.

Separately therefrom, 30 parts by weight of styrene, 8 parts by weight of butyl acrylate, 2 parts by weight of acrylic acid, 1 part by weight of dodecanethiol, and 0.4 parts by weight of an anionic surfactant of sodium lauryl sulfate were dispersed in 50 parts by weight of an ion-exchange water and emulsified in a flask, and then the dispersion was heated to 70° C. under a nitrogen atmosphere. When the temperature of the dispersion reached 70° C., a solution prepared by dissolving 0.1 part by weight of ammonium persulfate in 8.5 parts by weight of an ion-exchange water was added thereto and reacted for 5 hours, to obtain a fine resin particle dispersion liquid. The resin particles had a volume average particle diameter of 0.12 μm, measured by SALD7000 (available from Shimadzu Corporation). This dispersion liquid is referred to as Dispersion Liquid 2.

90 parts by weight of the Dispersion Liquid 1, 9 parts by weight of the Dispersion Liquid 2, and 1 part by weight of calcium sulfate were stirred for 10 minutes at 6,000 rpm using ULTRA TURRAX T50 available from IKA, and heated to 60° C. and kept at the temperature for 1 hour. A part of this mixture was taken as a sample and cooled, and then its surface was observed by an SEM. As a result, it was found that the fine resin particles adhered to the surfaces of the coloring particles. 2 parts by weight of a dispersing agent of sodium dodecylbenzenesulfonate was added to the mixture to maintain the volume average particle diameter of the coloring particles at a certain level, and the mixture was heated to 90° C. and kept at the temperature for 3 hours to control the shapes of the particles.

The solid contents of the resultant dispersion liquid were repeatedly subjected to centrifugation using a centrifugal separator and washing with ion-exchange water such that the filtrate showed an electric conductivity of 50 μS/cm. Then, the solid contents were dried by a vacuum dryer until the water content became 0.3% by weight, to obtain toner particles.

After drying, 2 parts by weight of a hydrophobic silica and 0.5 parts by weight of titanium oxide were adsorbed to the toner particle surfaces as additives, to obtain a desired electrophotographic toner.

The electrophotographic toner had a volume average particle diameter of 4.5 μm measured by COULTER COUNTER available from Beckman Coulter, Inc., and had a circularity of 0.98 measured by FPIA2100 available from Sysmex Corporation. Further, the yield was 98%.

The obtained electrophotographic toner and a carrier were kept under low-temperature, low-humidity conditions (10° C., 20%) and high-temperature, high-humidity conditions (30° C., 85%) for 8 hours or more. Then, 5 parts by weight of the electrophotographic toner and 95 parts by weight of the carrier were mixed in a plastic vessel, and stirred for 30 minutes by a turbula shaker mixer, and the charge of the mixture was measured by a suction blow-off apparatus (TTB-200 available from Kyocera Chemical Corporation). The charge of the toner kept under the low-temperature, low-humidity conditions (hereinafter referred to as q/m (L/L)) was 35.0, and the charge of the toner kept under the high-temperature, high-humidity conditions (hereinafter referred to as q/m (H/H)) was 31.2. The environmental variation of the toner was calculated by the following equation as an index of the environmental charge stability. As a result, the toner had an environmental variation of 0.89. When the environmental variation is 0.80 or more, an excellent image can be formed regardless of environmental atmosphere.

$$\text{Environmental Variation}=q/m(H/H)/q/m(L/L)$$

Then, the electrophotographic toner was put in a multi function peripheral e-STUDIO 281c available from Toshiba Tec Corporation, modified for evaluation. The temperature of its fixing unit was purposely changed, and the minimum fixing unit temperature, at which the toner could form an excellent image, was evaluated. As a result, the minimum fixing unit temperature was 150° C. Further, the transfer property of the electrophotographic toner was evaluated, and it was found that 99% of the toner developed on a photoreceptor was transferred onto paper.

The results are shown in Table 1.

EXAMPLE 2

36 parts by weight of a polyester resin, 2 parts by weight of a carbon black, 1.6 parts by weight of an ester wax, 0.4 parts by weight of a charge controlling agent, 4 parts by weight of an anionic surfactant of sodium dodecylbenzenesulfonate, 1 part by weight of an amine compound, and 55 parts by weight of an ion-exchange water were put in CLEAR MIX available from M Technique Co., Ltd., heated to a sample temperature of 95° C., and then stirred for 30 minutes at a revolution rate of 6,000 rpm of the CLEAR MIX. After the completion of the mechanical shearing, the dispersion liquid was cooled to ordinary temperature.

The obtained coloring particles had a volume average particle diameter of 4.6 μm, measured by COULTER COUNTER available from Beckman Coulter, Inc. Thus-obtained dispersion liquid is referred to as Dispersion Liquid 3.

Then, 90 parts by weight of the Dispersion Liquid 3, 9 parts by weight of the Dispersion Liquid 2, and 1 part by weight of calcium sulfate were stirred for 10 minutes at 6,000 rpm using ULTRA TURRAX T50 available from IKA, and heated to 60° C. and kept at the temperature for 1 hour. A part of this mixture was taken as a sample and cooled, and then its surface was observed by an SEM. As a result, it was found that the fine resin particles adhered to the surfaces of the coloring particles. 2 parts by weight of a dispersing agent of sodium dodecylbenzenesulfonate was added to the mixture to maintain the volume average particle diameter of the coloring particles at a certain level, and the mixture was heated to 90° C. and kept at the temperature for 3 hours to control the shapes of the particles.

The solid contents of the resultant dispersion liquid were repeatedly subjected to centrifugation using a centrifugal separator and washing with ion-exchange water such that the filtrate showed an electric conductivity of 50 ES/cm. Then, the solid contents were dried by a vacuum dryer until the water content became 0.3% by weight, to obtain toner particles.

After drying, 2 parts by weight of a hydrophobic silica and 0.5 parts by weight of titanium oxide were adsorbed to the toner particle surfaces as additives, to obtain a desired electrophotographic toner.

The obtained electrophotographic toner had a volume average particle diameter of 4.6 μm measured by COULTER COUNTER available from Beckman Coulter, Inc., and had a circularity of 0.98 measured by FPIA2100 available from Sysmex Corporation. Further, the yield was 98%.

As a result of evaluating the obtained electrophotographic toner in the same manner as Example 1, the toner showed an environmental variation of 0.90, a fixing temperature (a minimum fixing unit temperature) of 150° C., and a transfer efficiency of 99%.

The results are shown in Table 1.

EXAMPLE 3

90 parts by weight of a binder resin of polyester resin, 5 parts by weight of a colorant of carbon black, 4 parts by weight of an ester wax, and 1 part by weight of a charge controlling agent of zirconia metal complex were mixed and melt-kneaded by a 2-axis kneading apparatus at 120° C., to obtain a kneaded mixture.

The obtained kneaded mixture was coarse-pulverized into a volume average particle diameter of 1.2 mm by HAMMER MILL available from Nara Machinery Co., Ltd. to obtain coarse particles.

40 parts by weight of the coarse particles, 4 parts by weight of an anionic surfactant of sodium dodecylbenzenesulfonate, 1 part by weight of an amine compound of triethylamine, and 55 parts by weight of an ion-exchange water were put in CLEAR MIX available from M Technique Co., Ltd.

The dispersion liquid in the CLEAR MIX was heated to 120° C., and was mechanically sheared for 30 minutes at a revolution rate of 10,000 rpm of the CLEAR MIX. After the completion of the mechanical shearing, a part of the dispersion liquid was taken off and cooled to ordinary temperature.

The obtained fine coloring particles had a volume average particle diameter of 0.45 μm, measured by SALD7000 (available from Shimadzu Corporation).

Hydrochloric acid was added to the dispersion liquid kept at 55° C., and the fine coloring particles were aggregated into a desired volume average particle diameter by changing pH to acidic, to obtain coloring particles. The obtained coloring particles had a volume average particle diameter of 4.6 μm measured by COULTER COUNTER available from Beckman Coulter, Inc. Thus-obtained dispersion liquid is referred to as Dispersion Liquid 4.

Then, 90 parts by weight of the Dispersion Liquid 4, 9 parts by weight of the Dispersion Liquid 2, and 1 part by weight of calcium sulfate were stirred for 10 minutes at 6,000 rpm using ULTRA TURRAX T50 available from IKA, and heated to 60° C. and kept at the temperature for 1 hour. A part of this mixture was taken as a sample and cooled, and then its surface was observed by an SEM. As a result, it was found that the fine resin particles adhered to the surfaces of the coloring particles. 2 parts by weight of a dispersing agent of sodium dodecylbenzenesulfonate was added to the mixture to maintain the volume average particle diameter of the coloring particles at a certain level, and the mixture was heated to 90° C. and kept at the temperature for 3 hours to control the shapes of the particles.

The solid contents of the resultant dispersion liquid were repeatedly subjected to centrifugation using a centrifugal separator and washing with ion-exchange water such that the filtrate showed an electric conductivity of 50 ES/cm. Then, the solid contents were dried by a vacuum dryer until the water content became 0.3% by weight, to obtain toner particles.

After drying, 2 parts by weight of a hydrophobic silica and 0.5 parts by weight of titanium oxide were adsorbed to the toner particle surfaces as additives, to obtain a desired electrophotographic toner.

The obtained electrophotographic toner had a volume average particle diameter of 4.6 μm measured by COULTER COUNTER available from Beckman Coulter, Inc., and had a circularity of 0.98 measured by FPIA2100 available from Sysmex Corporation. Further, the yield was 98%.

As a result of evaluating the obtained electrophotographic toner in the same manner as Example 1, the toner showed an environmental variation of 0.90, a fixing temperature of 150° C., and a transfer efficiency of 98%.

The results are shown in Table 1.

EXAMPLE 4

36 parts by weight of a polyester resin, 2 parts by weight of a carbon black, 1.6 parts by weight of an ester wax, 0.4 parts by weight of a charge controlling agent, 4 parts by weight of an anionic surfactant, 1 part by weight of an amine compound, and 55 parts by weight of an ion-exchange water were put in the CLEAR MIX. The dispersion liquid was heated to 120° C. of a sample temperature, and was stirred for 30 minutes at a revolution rate of 10,000 rpm of the CLEAR MIX available from M Technique Co., Ltd. After the completion of the mechanical shearing, a part of the dispersion liquid was taken off and cooled to ordinary temperature.

The obtained fine coloring particles had a volume average particle diameter of 0.49 μm, measured by SALD7000 (available from Shimadzu Corporation).

An aqueous calcium sulfate solution was gradually added to the dispersion liquid kept at 55° C., and the fine coloring particles were aggregated into a desired volume average particle diameter to obtain coloring particles.

The obtained coloring particles had a volume average particle diameter of 4.3 μm measured by COULTER COUNTER available from Beckman Coulter, Inc. Thus-obtained dispersion liquid is referred to as Dispersion Liquid 5.

Then, 90 parts by weight of the Dispersion Liquid 5, 9 parts by weight of the Dispersion Liquid 2, and 1 part by weight of calcium sulfate were stirred for 10 minutes at 6,000 rpm using ULTRA TURRAX T50 available from IKA, and heated to 60° C. and kept at the temperature for 1 hour. A part of this mixture was taken as a sample and cooled, and then its surface was observed by an SEM. As a result, it was found that the fine resin particles adhered to the surfaces of the coloring particles. 2 parts by weight of a dispersing agent of sodium dodecylbenzenesulfonate was added to the mixture to maintain the volume average particle diameter of the coloring particles at a certain level, and the mixture was heated to 90° C. and kept at the temperature for 3 hours to control the shapes of the particles.

The solid contents of the resultant dispersion liquid were repeatedly subjected to centrifugation using a centrifugal separator and washing with ion-exchange water such that the filtrate showed an electric conductivity of 50 ES/cm. Then, the solid contents were dried by a vacuum dryer until the water content became 0.3% by weight, to obtain toner particles.

After drying, 2 parts by weight of a hydrophobic silica and 0.5 parts by weight of titanium oxide were adsorbed to the toner particle surfaces as additives, to obtain a desired electrophotographic toner.

The obtained electrophotographic toner had a volume average particle diameter of 4.4 μm measured by COULTER COUNTER available from Beckman Coulter, Inc., and had a circularity of 0.97 measured by FPIA2100 available from Sysmex Corporation. Further, the yield was 97%.

As a result of evaluating the obtained electrophotographic toner in the same manner as Example 1, the toner showed an environmental variation of 0.91, a fixing temperature of 150° C., and a transfer efficiency of 97%.

The results are shown in Table 1.

EXAMPLE 5

The coarse particles used in Example 1 were further coarse-pulverized to obtain intermediate particles having a volume average particle diameter of 168 μm. 40 parts by weight of the intermediate particles, 4 parts by weight of an anionic surfactant of sodium dodecylbenzenesulfonate, 1 part by weight of an amine compound of triethylamine, and 55 parts by weight of an ion-exchange water were pre-dispersed by ULTRA TURRAX T50 available from IK to obtain a Pre-Dispersion Liquid 1.

The Pre-Dispersion Liquid 1 was put in NANOMIZER (available from Yoshida Kikai Co., Ltd., YSNM-2000AR equipped with a heating system). The Pre-Dispersion Liquid 1 was treated 3 times at a heating system temperature of 120° C. under 100-MPa treatment pressure of the NANOMIZER. After cooling, the obtained coloring particles had a volume average particle diameter of 4.8 μm measured by SALD7000 (available from Shimadzu Corporation).

This dispersion liquid is referred to as Dispersion Liquid 6.

Then, 90 parts by weight of the Dispersion Liquid 6, 9 parts by weight of the Dispersion Liquid 2, and 1 part by weight of calcium sulfate were stirred for 10 minutes at 6,000 rpm using ULTRA TURRAX T50 available from IKA, and heated to 60° C. and kept at the temperature for 1 hour. A part of this mixture was taken as a sample and cooled, and then its surface was observed by an SEM. As a result, it was found that the fine resin particles adhered to the surfaces of the coloring particles. 2 parts by weight of a dispersing agent of sodium dodecylbenzenesulfonate was added to the mixture to maintain the volume average particle diameter of the coloring particles at a certain level, and the mixture was heated to 90° C. and kept at the temperature for 3 hours to control the shapes of the particles.

The solid contents of the resultant dispersion liquid were repeatedly subjected to centrifugation using a centrifugal separator and washing with ion-exchange water such that the filtrate showed an electric conductivity of 50 ES/cm. Then, the solid contents were dried by a vacuum dryer until the water content became 0.3% by weight, to obtain toner particles.

After drying, 2 parts by weight of a hydrophobic silica and 0.5 parts by weight of titanium oxide were adsorbed to the toner particle surfaces as additives, to obtain a desired electrophotographic toner.

The obtained electrophotographic toner had a volume average particle diameter of 4.8 μm measured by COULTER COUNTER available from Beckman Coulter, Inc., and had a circularity of 0.98 measured by FPIA2100 available from Sysmex Corporation. Further, the yield was 99%.

As a result of evaluating the obtained electrophotographic toner in the same manner as Example 1, the toner showed an environmental variation of 0.88, a fixing temperature of 150° C., and a transfer efficiency of 98%.

The results are shown in Table 1.

EXAMPLE 6

90 parts by weight of a polyester resin, 5 parts by weight of a cyan pigment, 4 parts by weight of an ester wax, and 1 parts by weight of a charge controlling agent were mixed, and intermediate-pulverized into a volume average particle diameter of 162 μm by HAMMER MILL available from Nara Machinery Co., Ltd. to obtain intermediate particles.

40 parts by weight of the intermediate particles, 4 parts by weight of an anionic surfactant of sodium dodecylbenzenesulfonate, 1 part by weight of an amine compound of triethylamine, and 55 parts by weight of an ion-exchange water were pre-dispersed by ULTRA TURRAX T50 available from IK to obtain a Pre-Dispersion Liquid 2.

The Pre-Dispersion Liquid 2 was put in NANOMIZER (available from Yoshida Kikai Co., Ltd., YSNM-2000AR equipped with a heating system). The Pre-Dispersion Liquid 2 was treated 3 times at a heating system temperature of 120° C. under 100-MPa treatment pressure of the NANOMIZER. After cooling, the obtained coloring particles had a volume average particle diameter of 4.9 μm measured by SALD7000 (available from Shimadzu Corporation). This dispersion liquid is referred to as Dispersion Liquid 7.

Then, 90 parts by weight of the Dispersion Liquid 7, 9 parts by weight of the Dispersion Liquid 2, and 1 part by weight of calcium sulfate were stirred for 10 minutes at 6,000 rpm using ULTRA TURRAX T50 available from IKA, and heated to 60° C. and kept at the temperature for 1 hour. A part of this mixture was taken as a sample and cooled, and then its surface was observed by an SEM. As a result, it was found that the fine resin particles adhered to the surfaces of the coloring particles. 2 parts by weight of a dispersing agent of sodium dodecylbenzenesulfonate was added to the mixture to maintain the volume average particle diameter of the coloring particles at a certain level, and the mixture was heated to 90° C. and kept at the temperature for 3 hours to control the shapes of the particles.

The solid contents of the resultant dispersion liquid were repeatedly subjected to centrifugation using a centrifugal separator and washing with ion-exchange water such that the filtrate showed an electric conductivity of 50 ES/cm. Then, the solid contents were dried by a vacuum dryer until the water content became 0.3% by weight, to obtain toner particles.

After drying, 2 parts by weight of a hydrophobic silica and 0.5 parts by weight of titanium oxide were adsorbed to the toner particle surfaces as additives, to obtain a desired electrophotographic toner.

The obtained electrophotographic toner had a volume average particle diameter of 4.9 μm measured by COULTER COUNTER available from Beckman Coulter, Inc., and had a circularity of 0.98 measured by FPIA2100 available from Sysmex Corporation. Further, the yield was 99%.

As a result of evaluating the obtained electrophotographic toner in the same manner as Example 1, the toner showed an environmental variation of 0.90, a fixing temperature of 150° C., and a transfer efficiency of 97%.

The results are shown in Table 1.

EXAMPLE 7

The Pre-Dispersion Liquid 1 used in Example 5 was put in NANOMIZER (available from Yoshida Kikai Co., Ltd., YSNM-2000AR equipped with a heating system). The Pre-Dispersion Liquid 1 was treated 3 times at a heating system temperature of 160° C. under 160-MPa treatment pressure of the NANOMIZER. After cooling, the obtained coloring particles had a volume average particle diameter of 0.56 μm measured by SALD7000 (available from Shimadzu Corporation).

Hydrochloric acid was added to the dispersion liquid treated by the NANOMIZER and kept at 55° C., and the fine coloring particles were aggregated into a desired volume average particle diameter by gradually changing pH to acidic, to obtain coloring particles. The obtained coloring particles had a volume average particle diameter of 4.2 μm measured by COULTER COUNTER available from Beckman Coulter, Inc. Thus-obtained dispersion liquid is referred to as Dispersion Liquid 8.

Then, 90 parts by weight of the Dispersion Liquid 8, 9 parts by weight of the Dispersion Liquid 2, and 1 part by weight of calcium sulfate were stirred for 10 minutes at 6,000 rpm using ULTRA TURRAX T50 available from IKA, and heated to 60° C. and kept at the temperature for 1 hour. A part of this mixture was taken as a sample and cooled, and then its surface was observed by an SEM. As a result, it was found that the fine resin particles adhered to the surfaces of the coloring particles. 2 parts by weight of a dispersing agent of sodium dodecylbenzenesulfonate was added to the mixture to maintain the volume average particle diameter of the coloring particles at a certain level, and the mixture was heated to 90° C. and kept at the temperature for 3 hours to control the shapes of the particles.

The solid contents of the resultant dispersion liquid were repeatedly subjected to centrifugation using a centrifugal separator and washing with ion-exchange water such that the filtrate showed an electric conductivity of 50 μS/cm. Then, the solid contents were dried by a vacuum dryer until the water content became 0.3% by weight, to obtain toner particles.

After drying, 2 parts by weight of a hydrophobic silica and 0.5 parts by weight of titanium oxide were adsorbed to the toner particle surfaces as additives, to obtain a desired electrophotographic toner.

The obtained electrophotographic toner had a volume average particle diameter of 4.2 μm measured by COULTER COUNTER available from Beckman Coulter, Inc., and had a circularity of 0.97 measured by FPIA2100 available from Sysmex Corporation. Further, the yield was 98%.

As a result of evaluating the obtained electrophotographic toner in the same manner as Example 1, the toner showed an environmental variation of 0.86, a fixing temperature of 150° C., and a transfer efficiency of 96%.

The results are shown in Table 1.

EXAMPLE 8

The Pre-Dispersion Liquid 2 used in Example 6 was put in NANOMIZER (available from Yoshida Kikai Co., Ltd., YSNM-2000AR equipped with a heating system). The Pre-Dispersion Liquid 2 was treated 3 times at a heating system temperature of 160° C. under 160-MPa treatment pressure of the NANOMIZER. After cooling, the obtained coloring particles had a volume average particle diameter of 0.61 μm measured by SALD7000 (available from Shimadzu Corporation).

An aqueous calcium sulfate solution was gradually added to the dispersion liquid kept at 55° C., and the fine coloring particles were aggregated into a desired volume average particle diameter to obtain coloring particles.

The obtained coloring particles had a volume average particle diameter of 4.5 μm measured by COULTER COUNTER available from Beckman Coulter, Inc. Thus-obtained dispersion liquid is referred to as Dispersion Liquid 9.

Then, 90 parts by weight of the Dispersion Liquid 9, 9 parts by weight of the Dispersion Liquid 2, and 1 part by weight of calcium sulfate were stirred for 10 minutes at 6,000 rpm using ULTRA TURRAX T50 available from IKA, and heated to 60° C. and kept at the temperature for 1 hour. A part of this mixture was taken as a sample and cooled, and then its surface was observed by an SEM. As a result, it was found that the fine resin particles adhered to the surfaces of the coloring particles. 2 parts by weight of a dispersing agent of sodium dodecylbenzenesulfonate was added to the mixture to maintain the volume average particle diameter of the coloring particles at a certain level, and the mixture was heated to 90° C. and kept at the temperature for 3 hours to control the shapes of the particles.

The solid contents of the resultant dispersion liquid were repeatedly subjected to centrifugation using a centrifugal separator and washing with ion-exchange water such that the filtrate showed an electric conductivity of 50 μS/cm. Then, the solid contents were dried by a vacuum dryer until the water content became 0.3% by weight, to obtain toner particles.

After drying, 2 parts by weight of a hydrophobic silica and 0.5 parts by weight of titanium oxide were adsorbed to the toner particle surfaces as additives, to obtain a desired electrophotographic toner.

The obtained electrophotographic toner had a volume average particle diameter of 4.5 μm measured by COULTER COUNTER available from Beckman Coulter, Inc., and had a circularity of 0.97 measured by FPIA2100 available from Sysmex Corporation. Further, the yield was 99%.

As a result of evaluating the obtained electrophotographic toner in the same manner as Example 1, the toner showed an environmental variation of 0.88, a fixing temperature of 150° C., and a transfer efficiency of 96%.

The results are shown in Table 1.

EXAMPLE 9

80 parts by weight of the Dispersion Liquid 1 used in Example 1 and 4 parts by weight of a methyl methacrylate monomer were mixed and heated to 70° C. under a nitrogen atmosphere. When the temperature of the mixture reached 70° C., a solution prepared by dissolving 0.05 parts by weight of ammonium persulfate in 15.95% of an ion-exchange water was added thereto and reacted for 4 hours. Then, 2 parts by weight of a dispersing agent of sodium dodecylbenzenesulfonate was added to the mixture to maintain the volume average particle diameter of the coloring particles at a certain level, and the mixture was heated to 90° C. and kept at the temperature for 3 hours to control the shapes of the particles.

The solid contents of the resultant dispersion liquid were repeatedly subjected to centrifugation using a centrifugal separator and washing with ion-exchange water such that the filtrate showed an electric conductivity of 50 μS/cm. Then, the solid contents were dried by a vacuum dryer until the water content became 0.3% by weight, to obtain toner particles.

After drying, 2 parts by weight of a hydrophobic silica and 0.5 parts by weight of titanium oxide were adsorbed to the toner particle surfaces as additives, to obtain a desired electrophotographic toner.

The obtained electrophotographic toner had a volume average particle diameter of 4.6 μm measured by COULTER COUNTER available from Beckman Coulter, Inc., and had a circularity of 0.99 measured by FPIA2100 available from Sysmex Corporation. Further, the yield was 96%.

As a result of evaluating the obtained electrophotographic toner in the same manner as Example 1, the toner showed an environmental variation of 0.85, a fixing temperature of 150° C., and a transfer efficiency of 98%.

The results are shown in Table 1.

EXAMPLE 10

80 parts by weight of the Dispersion Liquid 3 used in Example 2 and 4 parts by weight of a methyl methacrylate monomer were mixed and heated to 70° C. under a nitrogen atmosphere. When the temperature of the mixture reached 70° C., a solution prepared by dissolving 0.05 parts by weight of ammonium persulfate in 15.95% of an ion-exchange water was added thereto and reacted for 4 hours. Then, 2 parts by weight of a dispersing agent of sodium dodecylbenzenesulfonate was added to the mixture to maintain the volume average particle diameter of the coloring particles at a certain level, and the mixture was heated to 90° C. and kept at the temperature for 3 hours to control the shapes of the particles.

The solid contents of the resultant dispersion liquid were repeatedly subjected to centrifugation using a centrifugal separator and washing with ion-exchange water such that the filtrate showed an electric conductivity of 50 μS/cm. Then, the solid contents were dried by a vacuum dryer until the water content became 0.3% by weight, to obtain toner particles.

After drying, 2 parts by weight of a hydrophobic silica and 0.5 parts by weight of titanium oxide were adsorbed to the toner particle surfaces as additives, to obtain a desired electrophotographic toner.

The obtained electrophotographic toner had a volume average particle diameter of 4.7 μm measured by COULTER COUNTER available from Beckman Coulter, Inc., and had a circularity of 0.98 measured by FPIA2100 available from Sysmex Corporation. Further, the yield was 97%.

As a result of evaluating the obtained electrophotographic toner in the same manner as Example 1, the toner showed an environmental variation of 0.86, a fixing temperature of 150° C., and a transfer efficiency of 97%.

The results are shown in Table 1.

EXAMPLE 11

80 parts by weight of the Dispersion Liquid 4 used in Example 3 and 4 parts by weight of a methyl methacrylate monomer were mixed and heated to 70° C. under a nitrogen atmosphere. When the temperature of the mixture reached 70° C., a solution prepared by dissolving 0.05 parts by weight of ammonium persulfate in 15.95% of an ion-exchange water was added thereto and reacted for 4 hours. Then, 2 parts by weight of a dispersing agent of sodium dodecylbenzenesulfonate was added to the mixture to maintain the volume average particle diameter of the coloring particles at a certain level, and the mixture was heated to 90° C. and kept at the temperature for 3 hours to control the shapes of the particles.

The solid contents of the resultant dispersion liquid were repeatedly subjected to centrifugation using a centrifugal separator and washing with ion-exchange water such that the filtrate showed an electric conductivity of 50 μS/cm. Then, the solid contents were dried by a vacuum dryer until the water content became 0.3% by weight, to obtain toner particles.

After drying, 2 parts by weight of a hydrophobic silica and 0.5 parts by weight of titanium oxide were adsorbed to the toner particle surfaces as additives, to obtain a desired electrophotographic toner.

The obtained electrophotographic toner had a volume average particle diameter of 4.7 μm measured by COULTER COUNTER available from Beckman Coulter, Inc., and had a circularity of 0.97 measured by FPIA2100 available from Sysmex Corporation. Further, the yield was 98%.

As a result of evaluating the obtained electrophotographic toner in the same manner as Example 1, the toner showed an environmental variation of 0.89, a fixing temperature of 150° C., and a transfer efficiency of 96%.

The results are shown in Table 1.

EXAMPLE 12

80 parts by weight of the Dispersion Liquid 5 used in Example 4 and 4 parts by weight of a methyl methacrylate monomer were mixed and heated to 70° C. under a nitrogen atmosphere. When the temperature of the mixture reached 70° C., a solution prepared by dissolving 0.05 parts by weight of ammonium persulfate in 15.95% of an ion-exchange water was added thereto and reacted for 4 hours. Then, 2 parts by weight of a dispersing agent of sodium dodecylbenzenesulfonate was added to the mixture to maintain the volume average particle diameter of the coloring particles at a certain level, and the mixture was heated to 90° C. and kept at the temperature for 3 hours to control the shapes of the particles.

The solid contents of the resultant dispersion liquid were repeatedly subjected to centrifugation using a centrifugal separator and washing with ion-exchange water such that the filtrate showed an electric conductivity of 50 μS/cm. Then, the solid contents were dried by a vacuum dryer until the water content became 0.3% by weight, to obtain toner particles.

After drying, 2 parts by weight of a hydrophobic silica and 0.5 parts by weight of titanium oxide were adsorbed to the toner particle surfaces as additives, to obtain a desired electrophotographic toner.

The obtained electrophotographic toner had a volume average particle diameter of 4.5 μm measured by COULTER COUNTER available from Beckman Coulter, Inc., and had a circularity of 0.97 measured by FPIA2100 available from Sysmex Corporation. Further, the yield was 96%.

As a result of evaluating the obtained electrophotographic toner in the same manner as Example 1, the toner showed an environmental variation of 0.90, a fixing temperature of 150° C., and a transfer efficiency of 96%.

The results are shown in Table 1.

EXAMPLE 13

2 parts by weight of sodium dodecylbenzenesulfonate was added to the Dispersion Liquid 1 used in Example 1, and the liquid was heated to 90° C. and kept at the temperature for 3 hours to control the shapes of the particles.

The solid contents of the resultant dispersion liquid were repeatedly subjected to centrifugation using a centrifugal separator and washing with ion-exchange water such that the filtrate showed an electric conductivity of 50 μS/cm. Then, the solid contents were dried by a vacuum dryer until the water content became 0.3% by weight, to obtain coloring particles.

The solid contents of the Dispersion Liquid 2 used in Example 1 were repeatedly subjected to centrifugation using a centrifugal separator, removal of a supernatant liquid, and washing with ion-exchange water such that the filtrate showed an electric conductivity of 50 μS/cm. Then, the solid contents were dried by a vacuum dryer until the water content became 0.3% by weight, and pulverized to obtain Fine Resin Particle Powder (1).

10 parts by weight of the Fine Resin Particle Powder (1) was mechanically attached to the surfaces of 90 parts by weight of the coloring particles by HYBRIDIZER (available from Nara Machinery Co., Ltd.), and the surfaces of the coloring particles were uniformly coated using SURFUSING SYSTEM (available from Nippon Pneumatic Mfg. Co., Ltd.)

2 parts by weight of a hydrophobic silica and 0.5 parts by weight of titanium oxide were adsorbed to the surfaces of the coloring particles coated with the resin, to obtain a desired electrophotographic toner.

The obtained electrophotographic toner had a volume average particle diameter of 4.7 μm measured by COULTER COUNTER available from Beckman Coulter, Inc., and had a circularity of 0.98 measured by FPIA2100 available from Sysmex Corporation. Further, the yield was 96%.

As a result of evaluating the obtained electrophotographic toner in the same manner as Example 1, the toner showed an environmental variation of 0.92, a fixing temperature of 150° C., and a transfer efficiency of 95%.

The results are shown in Table 1.

EXAMPLE 14

2 parts by weight of sodium dodecylbenzenesulfonate was added to the Dispersion Liquid 3 used in Example 2, and the liquid was heated to 90° C. and kept at the temperature for 3 hours to control the shapes of the particles.

The solid contents of the resultant dispersion liquid were repeatedly subjected to centrifugation using a centrifugal separator and washing with ion-exchange water such that the filtrate showed an electric conductivity of 50 ES/cm. Then, the solid contents were dried by a vacuum dryer until the water content became 0.3% by weight, to obtain coloring particles.

10 parts by weight of the Fine Resin Particle Powder (1) was mechanically attached to the surfaces of 90 parts by weight of the coloring particles by HYBRIDIZER (available from Nara Machinery Co., Ltd.), and the surfaces of the coloring particles were uniformly coated using SURFUSING SYSTEM (available from Nippon Pneumatic Mfg. Co., Ltd.)

2 parts by weight of a hydrophobic silica and 0.5 parts by weight of titanium oxide were adsorbed to the surfaces of the coloring particles coated with the resin, to obtain a desired electrophotographic toner.

The obtained electrophotographic toner had a volume average particle diameter of 4.7 μm measured by COULTER COUNTER available from Beckman Coulter, Inc., and had a circularity of 0.98 measured by FPIA2100 available from Sysmex Corporation. Further, the yield was 97%.

As a result of evaluating the obtained electrophotographic toner in the same manner as Example 1, the toner showed an environmental variation of 0.89, a fixing temperature of 150° C., and a transfer efficiency of 97%.

The results are shown in Table 1.

EXAMPLE 15

2 parts by weight of sodium dodecylbenzenesulfonate was added to the Dispersion Liquid 4 used in Example 3, and the liquid was heated to 90° C. and kept at the temperature for 3 hours to control the shapes of the particles.

The solid contents of the resultant dispersion liquid were repeatedly subjected to centrifugation using a centrifugal separator and washing with ion-exchange water such that the filtrate showed an electric conductivity of 50 ES/cm. Then, the solid contents were dried by a vacuum dryer until the water content became 0.3% by weight, to obtain coloring particles.

10 parts by weight of the Fine Resin Particle Powder (1) was mechanically attached to the surfaces of 90 parts by weight of the coloring particles by HYBRIDIZER (available from Nara Machinery Co., Ltd.), and the surfaces of the coloring particles were uniformly coated using SURFUSING SYSTEM (available from Nippon Pneumatic Mfg. Co., Ltd.)

2 parts by weight of a hydrophobic silica and 0.5 parts by weight of titanium oxide were adsorbed to the surfaces of the coloring particles coated with the resin, to obtain a desired electrophotographic toner.

The obtained electrophotographic toner had a volume average particle diameter of 4.6 μm measured by COULTER COUNTER available from Beckman Coulter, Inc., and had a circularity of 0.97 measured by FPIA2100 available from Sysmex Corporation. Further, the yield was 97%.

As a result of evaluating the obtained electrophotographic toner in the same manner as Example 1, the toner showed an environmental variation of 0.91, a fixing temperature of 150° C., and a transfer efficiency of 97%.

EXAMPLE 16

2 parts by weight of sodium dodecylbenzenesulfonate was added to the Dispersion Liquid 5 used in Example 4, and the liquid was heated to 90° C. and kept at the temperature for 3 hours to control the shapes of the particles.

The solid contents of the resultant dispersion liquid were repeatedly subjected to centrifugation using a centrifugal separator and washing with ion-exchange water such that the filtrate showed an electric conductivity of 50 μS/cm. Then, the solid contents were dried by a vacuum dryer until the water content became 0.3% by weight, to obtain coloring particles.

10 parts by weight of the Fine Resin Particle Powder (1) was mechanically attached to the surfaces of 90 parts by weight of the coloring particles by HYBRIDIZER (available from Nara Machinery Co., Ltd.), and the surfaces of the coloring particles were uniformly coated using SURFUSING SYSTEM (available from Nippon Pneumatic Mfg. Co., Ltd.)

2 parts by weight of a hydrophobic silica and 0.5 parts by weight of titanium oxide were adsorbed to the surfaces of the coloring particles coated with the resin, to obtain a desired electrophotographic toner.

The obtained electrophotographic toner had a volume average particle diameter of 4.5 μm measured by COULTER COUNTER available from Beckman Coulter, Inc., and had a circularity of 0.96 measured by FPIA2100 available from Sysmex Corporation. Further, the yield was 98%.

As a result of evaluating the obtained electrophotographic toner in the same manner as Example 1, the toner showed an environmental variation of 0.91, a fixing temperature of 150° C., and a transfer efficiency of 98%.

The results are shown in Table 1.

Comparative Example 1

90 parts by weight of a polyester resin, 5 parts by weight of a cyan pigment, 4 parts by weight of an ester wax, and 1 part by weight of a charge controlling agent were mixed and treated with a 2-axis kneading apparatus at 120° C., to obtain a kneaded mixture. The kneaded mixture was repeatedly subjected to pulverizing and classification using an airflow pulverizer until the kneaded mixture had a volume average particle diameter of 4.5 to 5.0 μm. 2 parts by weight of a hydrophobic silica and 0.5 parts by weight of titanium oxide were adsorbed to the obtained pulverized product, to obtain a desired electrophotographic toner. The electrophotographic toner had a volume average particle diameter of 4.6 μm measured by COULTER COUNTER available from Beckman Coulter, Inc., and had a circularity of 0.89 measured by FPIA available from Sysmex Corporation. Further, the yield was 27%.

As a result of evaluating the obtained electrophotographic toner in the same manner as Example 1, the toner showed an environmental variation of 0.65, a fixing temperature of 150° C., and a transfer efficiency of 85%.

The results are shown in Table 1.

Comparative Example 2

30 parts by weight of styrene, 8 parts by weight of butyl acrylate, 2 parts by weight of acrylic acid, 1 part by weight of dodecanethiol, and 0.4 parts by weight of an anionic surfactant were dispersed in 50 parts by weight of an ion-exchange water and emulsified in a flask, and then the dispersion was heated to 70° C. under a nitrogen atmosphere. When the temperature of the dispersion reached 70° C., a solution prepared by dissolving 0.1 part by weight of ammonium persulfate in 8.5 parts by weight of an ion-exchange water was added thereto and reacted for 5 hours, to obtain a fine resin particle dispersion liquid. The resin particles had a volume average particle diameter of 0.12 μm, measured by SALD7000 (available from Shimadzu Corporation).

40 parts by weight of a cyan pigment, 0.4 parts by weight of an anionic surfactant, and 59.6 parts by weight of an ion-exchange water were treated with HOMOZINIZER to obtain a pigment dispersion liquid. The resultant particles had a volume average particle diameter of 0.35 μm, measured by SALD7000 (available from Shimadzu Corporation).

40 parts by weight of an ester wax, 0.4 parts by weight of an anionic surfactant, and 59.6 parts by weight of an ion-exchange water were treated with HOMOZINIZER under heating at 90° C., to obtain a wax dispersion liquid. The resultant particles had a volume average particle diameter of 0.19 μm, measured by SALD7000 (available from Shimadzu Corporation).

40 parts by weight of a charge control agent, 0.4 parts by weight of an anionic surfactant, and 59.6 parts by weight of an ion-exchange water were treated with HOMOZINIZER to obtain a charge control agent dispersion liquid. The resultant particles had a volume average particle diameter of 0.48 μm, measured by SALD7000 (available from Shimadzu Corporation).

90 parts by weight of the fine resin particle dispersion liquid, 5 parts by weight of the pigment dispersion liquid, 4 parts by weight of the wax dispersion liquid, and 1 part by weight of the charge control agent dispersion liquid were mixed. 1 part by weight of magnesium sulfate was added to the mixture liquid, and then the liquid was heated while stirring to 48° C. at a rate of 1° C./min, kept at the temperature for 2 hours, and heated to 70° C. at a rate of 1° C./min, to obtain coloring particles. The coloring particles were washed by a centrifugal separator such that the wash water showed an electric conductivity of 50 μS/cm, and were dried by a vacuum dryer until the water content became 0.3% by weight. After drying, 2 parts by weight of a hydrophobic silica and 0.5 parts by weight of titanium oxide were adsorbed to the particle surfaces, to obtain a desired electrophotographic toner. The electrophotographic toner had a volume average particle diameter of 4.7 μm measured by COULTER COUNTER available from Beckman Coulter, Inc., and had a circularity of 0.95 measured by FPIA available from Sysmex Corporation. Further, the yield was 95%.

As a result of evaluating the obtained electrophotographic toner in the same manner as Example 1, the toner showed an environmental variation of 0.71, a fixing temperature of 180° C., and a transfer efficiency of 92%.

Comparative Example 3

15.4 parts by weight of a polyester resin and 61.5 parts by weight of methylene chloride were stirred for 10 minutes at 6,000 rpm using ULTRA TURRAX T50 available from IKA, to dissolve the component. Then, an aqueous medium prepared by dissolving 4 parts by weight of an anionic surfactant of sodium dodecylbenzenesulfonate in 19.1 parts by weight of an ion-exchange water was added thereto, and stirred for 10 minutes at 10,000 rpm using ULTRA TURRAX T50 available from IKA. The methylene chloride in the obtained dispersion liquid was removed by an evaporator to obtain a fine polyester particle dispersion liquid having a volume average particle diameter of 720 nm and a polyester solid content of 40 parts by weight. It should be noted that this dispersion liquid was not emulsified and gel components were precipitated at the bottom.

90 parts by weight of the polyester resin dispersion liquid was mixed with 5 parts by weight of the pigment dispersion liquid, 4 parts by weight of the wax dispersion liquid, and 1 part by weight of the charge control agent dispersion liquid used in Comparative Example 2. 0.5 parts by weight of magnesium sulfate was added to the mixture liquid, and then the liquid was heated while stirring to 48° C. at a rate of 1° C./min, kept at the temperature for 2 hours, and heated to 70° C. at a rate of 1° C./min, to obtain coloring particles.

The obtained fine coloring particles had a volume average particle diameter of 4.5 μm measured by SALD7000 (available from Shimadzu Corporation).

Then, 90 parts by weight of the above dispersion liquid, 9 parts by weight of the Dispersion Liquid 2, and 1 part by weight of calcium sulfate were stirred for 10 minutes at 6,000 rpm using ULTRA TURRAX T50 available from IKA, heated to 60° C., and kept at the temperature for 1 hour. A part of this mixture was taken as a sample and cooled, and then its surface was observed by an SEM. As a result, it was found that the fine resin particles adhered to the surfaces of the coloring particles. 2 parts by weight of a dispersing agent of sodium dodecylbenzenesulfonate was added to the mixture to maintain the volume average particle diameter of the coloring particles at a certain level, and the mixture was heated to 90° C. and kept at the temperature for 3 hours to control the shapes of the particles.

The solid contents of the resultant dispersion liquid were repeatedly subjected to centrifugation using a centrifugal separator and washing with ion-exchange water such that the filtrate showed an electric conductivity of 50 ES/cm. Then, the solid contents were dried by a vacuum dryer until the water content became 0.3% by weight, to obtain toner particles.

After drying, 2 parts by weight of a hydrophobic silica and 0.5 parts by weight of titanium oxide were adsorbed to the toner particle surfaces as additives, to obtain a desired electrophotographic toner.

The obtained electrophotographic toner had a volume average particle diameter of 4.5 μm measured by COULTER COUNTER available from Beckman Coulter, Inc., and had a circularity of 0.98 measured by FPIA2100 available from Sysmex Corporation. Further, the yield was 79%. As a result of evaluating the obtained electrophotographic toner in the same manner as Example 1, the toner showed an environmental variation of 0.88, a fixing temperature of 170° C., and a transfer efficiency of 98%.

TABLE 1

| | | Toner particle diameter (μm) | Circularity | Yield (%) | Environmental variation (%) | Fixing temperature (° C.) | Transfer efficiency (%) | Overall evaluation |
|---|---|---|---|---|---|---|---|---|
| Example | 1 | 4.5 | 0.98 | 98 | 0.89 | 150 | 99 | ○ |
| | 2 | 4.6 | 0.98 | 98 | 0.90 | 150 | 99 | ○ |
| | 3 | 4.6 | 0.98 | 98 | 0.90 | 150 | 98 | ○ |
| | 4 | 4.4 | 0.97 | 97 | 0.91 | 150 | 97 | ○ |
| | 5 | 4.8 | 0.98 | 99 | 0.88 | 150 | 98 | ○ |
| | 6 | 4.9 | 0.98 | 99 | 0.90 | 150 | 97 | ○ |
| | 7 | 4.2 | 0.97 | 98 | 0.86 | 150 | 96 | ○ |
| | 8 | 4.5 | 0.97 | 99 | 0.88 | 150 | 96 | ○ |
| | 9 | 4.6 | 0.99 | 96 | 0.85 | 150 | 98 | ○ |
| | 10 | 4.7 | 0.98 | 97 | 0.86 | 150 | 97 | ○ |
| | 11 | 4.7 | 0.97 | 98 | 0.89 | 150 | 96 | ○ |
| | 12 | 4.5 | 0.97 | 96 | 0.90 | 150 | 96 | ○ |
| | 13 | 4.7 | 0.98 | 96 | 0.92 | 150 | 95 | ○ |
| | 14 | 4.7 | 0.98 | 97 | 0.89 | 150 | 97 | ○ |
| | 15 | 4.6 | 0.97 | 97 | 0.91 | 150 | 97 | ○ |
| | 16 | 4.5 | 0.96 | 98 | 0.91 | 150 | 98 | ○ |
| Comp. Example | 1 | 4.6 | 0.89 | 27 | 0.65 | 150 | 85 | X |
| | 2 | 4.7 | 0.95 | 95 | 0.71 | 180 | 92 | X |
| | 3 | 4.5 | 0.98 | 79 | 0.88 | 170 | 98 | Δ |

In the above table, the term "toner particle diameter" means the volume average particle diameter of the toner particles.

As is clear from Table 1, all the developing agents obtained in Examples 1 to 16 had the reduced particle diameters and were excellent in the circularity, yield, environmental variation, fixing temperature, and transfer efficiency.

However, the conventional pulverized toner of Comparative Example 1, produced by pulverizing the kneaded mixture, was poor in yield of the toner with the desired particle diameter, and insufficient in the circularity, environmental variation, and transfer efficiency.

Further, the polymerized toner of Comparative Example 2, produced by aggregating the polymerized fine particles of the acrylic styrene resin, the pigment, and the wax in the dispersion liquid, was poor in the environmental variation and cannot be fixed at low temperature, though it was not poor in the circularity, yield, and fixing efficiency.

Furthermore, the toner of Comparative Example 3, produced by adding the aqueous medium and the surfactant to the polyester binder resin dissolved in the organic solvent, and by aggregating the dispersed binder resin and the pigment dispersion liquid, was insufficient in the yield and cannot be fixed at low temperature, though it was excellent in the transfer efficiency.

The present invention is suitable for manufacturing coloring particles with small particle diameters, which can be used not only in the powder state but also in the mixture liquid state for wet electrophotographic methods.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A method for manufacturing a developing agent, comprising the steps of:

mixing a material mixture containing at least a binder resin and a colorant with an aqueous medium; wherein the material mixture is a granular mixture; and shearing the resultant liquid to mechanically, thereby fine-granulating the material mixture to form fine particles as cores; and forming a coating resin layer on the surfaces of the cores to obtain toner particles.

2. The method for manufacturing a developing agent according to claim 1, wherein the granular mixture is prepared by melt-kneading and coarse-pulverizing the material mixture containing the binder resin and the colorant.

3. The method for manufacturing a developing agent according to claim 1, wherein the method further comprises the step of aggregating the fine particles to form aggregated particles before the step of forming the coating resin layer, and the aggregated particles are used as the cores.

4. The method for manufacturing a developing agent according to claim 1, wherein the mechanical shearing is carried out at a temperature equal to or higher than the glass transition point of the binder resin.

5. The method for manufacturing a developing agent according to claim 1, wherein at least one of a surfactant and a pH adjusting agent is added to the aqueous medium in the step of mixing the material mixture with the aqueous medium.

6. The method for manufacturing a developing agent according to claim 5, wherein the pH adjusting agent is an amine compound.

7. The method for manufacturing a developing agent according to claim 5, wherein the surfactant is an anionic surfactant.

8. The method for manufacturing a developing agent according to claim 1, wherein the fine particles has a volume average particle diameter of 0.05 to 10 μm.

9. The method for manufacturing a developing agent according to claim 2, wherein the aggregated particles have a volume average particle diameter of 1 to 15 μm.

10. The method for manufacturing a developing agent according to claim 2, wherein the toner particles have a circularity of 0.8 to 1.0.

11. The method for manufacturing a developing agent according to claim 1, wherein the material mixture contains at least one of a wax and a charge controlling agent.

12. The method for manufacturing a developing agent according to claim 1, wherein the binder resin has an acid value of 1 or more.

13. The method for manufacturing a developing agent according to claim 12, wherein the binder resin is a polyester resin.

14. The method for manufacturing a developing agent according to claim 1, wherein in the step of aggregating, a plurality of the fine particles are aggregated by using at least one process of pH control, addition of a surfactant, addition of a water-soluble metal salt, addition of an organic solvent, and temperature control.

15. The method for manufacturing a developing agent according to claim 1, wherein in the step of forming the coating resin layer, fine particles containing a coating resin are attached to a surface of the cores.

16. The method for manufacturing a developing agent according to claim 15, wherein the fine particles containing the coating resin are wet-mixed with the cores.

17. The method for manufacturing a developing agent according to claim 16, wherein the wet-mixing is carried out in an aqueous medium.

18. The method for manufacturing a developing agent according to claim 15, wherein the fine particles containing the coating resin are dry-mixed with the cores.

19. The method for manufacturing a developing agent according to claim 15, wherein the fine particles containing the coating resin have a volume average particle diameter of 0.03 to 1 μm.

* * * * *